US005572974A

United States Patent [19]

Wakeman

[11] Patent Number: 5,572,974

[45] Date of Patent: Nov. 12, 1996

[54] COMBINED START BYPASS AND SAFETY PRESSURE RELIEF VALVE FOR A FUEL SYSTEM

[75] Inventor: Russell J. Wakeman, Newport News, Va.

[73] Assignee: Siemens Automotive Corporation, Auburn Hills, Mich.

[21] Appl. No.: 391,739

[22] Filed: Feb. 21, 1995

[51] Int. Cl.[6] ..... F02M 37/04

[52] U.S. Cl. ..... 123/497; 123/198 D; 123/467

[58] Field of Search ..... 123/510, 497, 123/198 D, 506, 457, 446, 179.17, 467

[56] References Cited

U.S. PATENT DOCUMENTS

| | | | |
|---|---|---|---|
| 3,742,926 | 7/1973 | Kemp | 123/467 |
| 4,077,376 | 3/1978 | Thoma | 123/467 |
| 4,246,876 | 1/1981 | Bouwkamp | 123/467 |
| 4,711,209 | 12/1987 | Henkle | 123/467 |
| 4,770,150 | 9/1988 | Fraenkle | 123/198 D |
| 4,893,603 | 1/1990 | Siebels | 123/510 |
| 5,168,855 | 12/1992 | Stone | 123/446 |
| 5,295,469 | 3/1994 | Kariya | 123/456 |
| 5,339,785 | 8/1994 | Wilksch | 123/497 |

*Primary Examiner*—Carl S. Miller
*Attorney, Agent, or Firm*—Russel C. Wells

[57] ABSTRACT

A high pressure fuel system includes a combination bypass and safety pressure release valve across the high pressure fuel pump. The combination valve allows the feed pump to directly provide fuel to the system before the high pressure pump reaches full output pressure. The valve also releases overpressure in the system when the high pressure pump is deadheaded. The combination valve includes a check ball which allows fuel to flow from its input to its output when the pressure is greater at its input than at its output.

10 Claims, 2 Drawing Sheets

COMBINED START BYPASS AND SAFETY PRESSURE RELIEF VALVE FOR A FUEL SYSTEM

FIELD OF THE INVENTION

The present invention relates generally to a fuel system for an engine, and more particularly to a method and apparatus for providing fuel to an engine in a high pressure fuel injection system.

BACKGROUND OF THE INVENTION

High pressure fuel injection systems typically include positive displacement pumps such as a swash plate pump or cam ring piston pump to provide highly pressurized fuel (e.g., 30–150 bar system pressure) to fuel injectors in an engine. The positive displacement pump or high pressure pump is mechanically coupled to the engine via a belt, gear, or clutch drive which turns the pump at a ratio of the engine speed. Thus, the performance of the high pressure pump is dependent on the speed of cranking, rotating, or turning of the engine.

Generally, the high pressure pump, which is driven by the engine, is not able to provide full or operating pressure at its output until the engine has been started. Providing the fuel at the operating pressure is necessary for the fuel injectors in the high pressure fuel system to provide proper atomization and high delivery rates.

High pressure fuel systems are typically equipped with a feed pump or conventional low pressure pump in the fuel tank which supplies the fuel to the high pressure pump in the engine compartment. The output of the low pressure pump is generally coupled to the input of the high pressure pump. The low pressure pumps are often electric pumps such as a vane pump, turbine pump, or roller pump and cannot create high system pressures required for atomization and high delivery rates. However, these pumps are able to relatively quickly provide low pressure fuel from the tank independent of engine revolutions.

The low pressure pumps provide the fuel at the specified low pressure as soon as the electrical system of the vehicle or other engine system is turned on. Generally, fuel cannot be directly provided by the low pressure pump through the high pressure pump to the engine because restrictive clearances in the pistons of the high pressure pump prevent fuel flow through the high pressure pump. Heretofore, starting an engine equipped with a high pressure pump is an objectionably slow process because the high pressure pump is not able to provide the fuel until the engine has been started, or cranked (e.g., turned over) a significant number of times.

Another problem associated with high pressure pumps involves the generation of extremely high output pressures when the high pressure pump is deadheaded, such as when the high pressure fuel system becomes a closed system due to a system failure. If the regulator or other parts of the high pressure fuel system malfunction, the high pressure pump can be deadheaded (e.g., have no path back to the fuel tank) and can generate extremely high pressures at the output of the pump. The high pressures may even exceed the proof pressure of the system, resulting in catastrophic failure of hoses or seals in the high pressure fuel system of the engine.

Thus, there is a need for a high pressure fuel system which quickly supplies fuel to the engine as the engine is started. Further, there is a need for a high pressure fuel injection system which allows the feed pump to directly provide fuel to the engine. Additionally, there is a need for a high pressure fuel system which includes overpressure protection.

SUMMARY OF THE INVENTION

The present invention relates to a check valve for use in a fuel system including a feed pump and a high pressure pump. The feed pump has a feed output coupled to a pump inlet of the high pressure pump. The feed pump provides fuel at a first pressure to the pump inlet. The check valve includes a valve inlet coupled to the pump inlet, a valve output coupled to a pump outlet of the high pressure pump, and a bypass assembly disposed between the valve inlet and the valve outlet. The bypass assembly is configured to allow fuel to flow from the valve inlet to the valve outlet when the first pressure is in a first predetermined relationship with a second pressure at the pump outlet. The bypass assembly thereby allows the fuel at the first pressure to bypass the high pressure pump.

The present invention also relates to a method of providing fuel in a fuel system from a tank to an engine as the engine is started. The fuel system includes a feed pump in fluid communication with the tank, a high pressure pump having a pump input and a pump output, and a bypass valve. The feed pump has a feed output in fluid communication with the pump input. The bypass valve includes a valve input in fluid communication with the pump input and a valve output in fluid communication with the pump output. The method includes the steps of providing the fuel at a first pressure with the feed pump to the pump input, allowing the fuel at the first pressure to flow from the valve input to the valve output through the bypass valve and preventing the fuel from flowing through the bypass valve from the valve output to the valve input as the engine is started, providing the fuel at the second pressure with the high pressure pump at the pump output, and preventing the fuel at the first pressure from flowing from the valve input through the bypass valve to the valve output after the engine is started.

The present invention even further relates to a fuel system for providing fuel from a tank to an engine. The fuel system includes a feed pump in fluid communication with the tank, a high pressure pump and a pump output, and a bypass valve including a valve input in fluid communication with the pump input, a valve output in fluid communication with the pump output, and a valve assembly disposed between the valve input and the valve output. The feed pump provided the fuel at a first pressure at a feed output. The feed output is in fluid communication with the pump input. The high pressure pump provides the fuel at a second pressure at the pump output. The second pressure is higher than the first pressure under normal conditions. The valve assembly allows the fuel to flow from the valve input to the valve output and prevents the fuel from flowing from the valve output to the valve input.

The present invention additionally relates to a combined start bypass and safety pressure relief valve for use in a fuel system in an engine. The fuel system includes a low pressure pump and a high pressure pump. The low pressure pump has a feed outlet and the high pressure pump has a pump inlet and a pump outlet. The feed outlet is coupled to the pump inlet and the low pressure pump provides fuel at a low pressure to the pump inlet. The high pressure pump provides the fuel at a high pressure exceeding the low pressure after the engine has been started. The combined start bypass and safety pressure relief valve includes a valve inlet coupled to the pump inlet, a valve output coupled to the pump outlet, a bypass means disposed between the valve inlet and the valve output and an overpressure means disposed between the valve inlet and the valve outlet. The bypass means provides fuel at the low pressure to the valve outlet before the engine has been started. The overpressure means provides the fuel from the valve outlet to the pump inlet when the high pressure exceeds an overpressure threshold.

In one exemplary aspect of the present invention, a combined start bypass and safety pressure relief valve can be provided across a high pressure pump in a high pressure gasoline fuel injection system. The valve advantageously provides a bypass for the low pressure fuel before the high pressure pump reaches operating pressure. Once the high pressure pump reaches operating pressure, the valve is closed and prevents fuel from flowing across the high pressure pump. Additionally, the valve can provide a relief outlet for the high pressure system when the high pressure fuel system reaches an overpressure condition such as when the high pressure pump is deadheaded.

In another exemplary aspect of the present invention, the start bypass valve can include a bypass assembly including a check ball, and check spring. The bypass assembly is disposed in a floating valve body. The floating valve body is also configured to cooperate with the valve housing to provide an overpressure release mechanism. The valve body is preferably mounted in a stepped bore in the housing of the high pressure pump and is in fluid communication with a pump inlet and a pump outlet of the high pressure pump.

The combined start bypass and safety pressure release valve advantageously reduces the amount of time to start an engine by providing low pressure fuel to the fuel system with a low pressure pump until the high pressure pump is driven by the engine. The high pressure pump may reach operating pressure during the cranking of the engine. The valve also advantageously returns fuel to the pump inlet without need for an added line to the fuel tank in the event of an overpressure condition. A relief mechanism in the valve is preferably a spring and piston relief assembly. The relief assembly is held closed until the force of an overpressure condition moves the assembly against the spring and opens a relief output.

BRIEF DESCRIPTION OF THE DRAWINGS

The invention will hereafter be described with reference to the accompanying drawings wherein like referenced numerals denote like elements, and.

DETAILED DESCRIPTION OF THE PREFERRED EXEMPLARY EMBODIMENT

Figure 1:
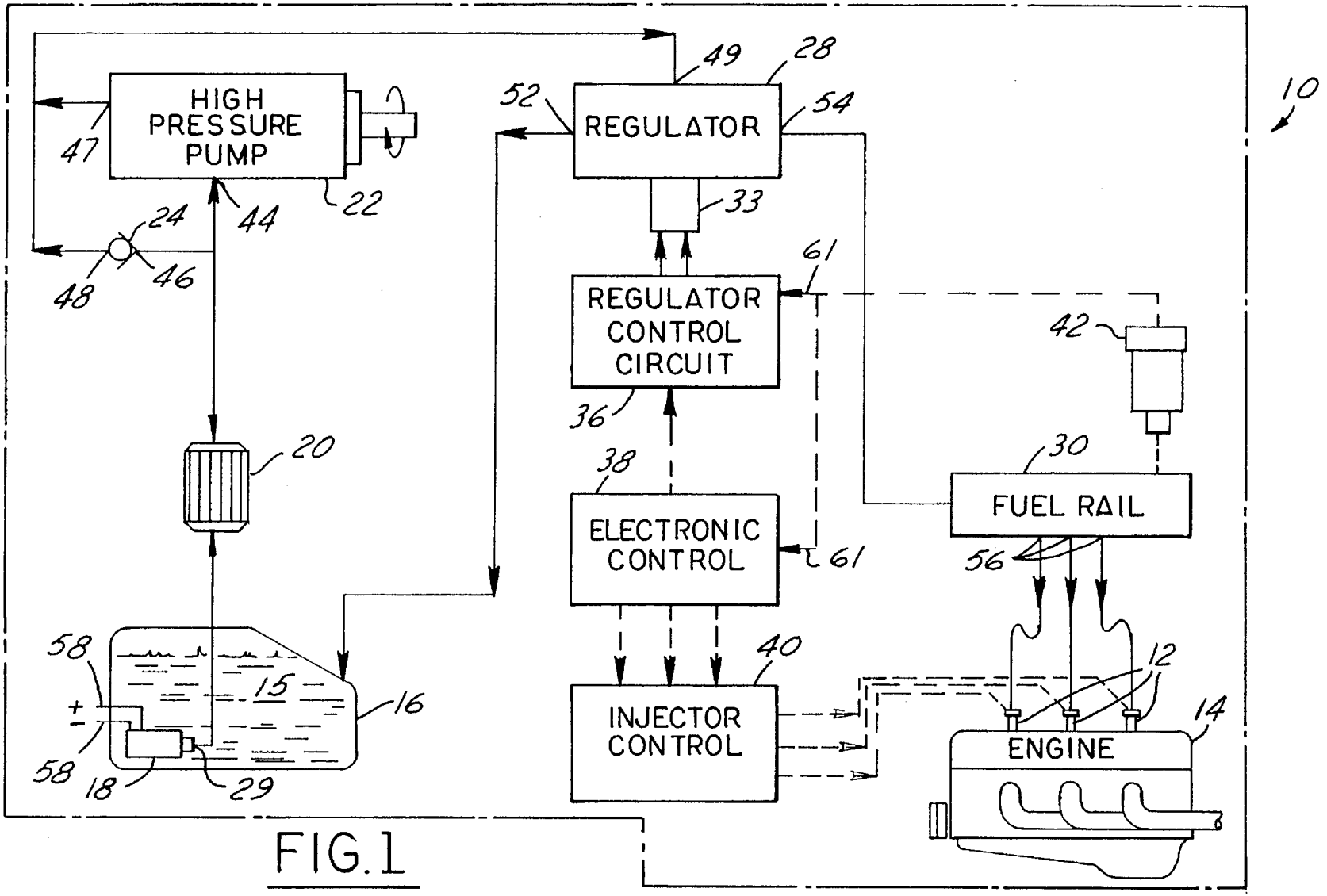
FIG. 1 is a simplified schematic block diagram of a high pressure fuel system including a check and relief valve for use with an engine in accordance with an exemplary embodiment of the present invention.

Referring generally to the schematic block diagram of FIG. 1, a high pressure fuel system 10 is coupled to fuel injectors 12 of an engine 14. Engine 14 may be a gasoline powered automobile engine or other combustion motor which utilizes fuel. High pressure fuel system 10 supplies fuel to fuel injectors 12 of engine 14. The fuel is provided at a high pressure such as 30 to 150 bar. The pressure of the fuel must be high enough for proper atomization and high delivery rates for engine 14.

High pressure fuel system 10 includes a fuel tank 16 having an in-tank electric pump or low pressure pump 18, a fuel filter 20, a positive displacement pump or high pressure pump 22, a combination check and relief valve 24, a high pressure regulator 28, a solenoid 33, a fuel rail 30, a regulator control circuit 36, an electronic control circuit 38, an injector driver circuit 40, and a pressure sensor 42. Low pressure fuel pump 18 is in fluid communication with fuel 15 in tank 16. Fuel 15 is preferably gasoline. Fuel pump 18 is a feed pump and has a feed outlet 29 coupled through fuel filter 20 to a pump input or inlet 44 of high pressure pump 22. Pump inlet 44 is coupled to a valve input or inlet 46 of valve 24, and a pump output or outlet 47 of high pressure pump 22 is coupled to a valve output or outlet 48 of valve 24.

Pump outlet 47 is also coupled to a regulator input 49 of regulator 28. Regulator 28 includes a tank outlet 52 coupled to tank 16 and a fuel rail output 54 coupled to fuel rail 30. Fuel rail 30 provides fuel to fuel injectors 12 at outputs 56. Fuel rail 30 is also in fluid communication with pressure sensor 42.

Low pressure pump 18 also includes electrical inputs 58 which receive electrical power for driving pump 18. Pump 18 is turned on by providing the electrical power to inputs 58. Electronic control circuit 38 receives a pressure signal from sensor 42 via a conductor 61 and provides electronic system control signals to regulator control circuit 36 and injector driver circuit 40 in response to the pressure signal on conductor 61 as well as other control criteria. Similarly, regulator control circuit 36 receives the pressure signal on conductor 61 and provides regulator control signals to solenoid 33 in response to the system control signals from electronic control circuit 38 and the pressure signal on conductor 61. Solenoid 33 controls regulator 28 in response to the regulator control signals.

Electronic driver circuit 40 is coupled to injectors 12 and provides drive signals to injectors 12 which control the distribution of the fuel to engine 14. Electronic control circuit 38 can cause driver circuit 40 to adjust the drive signals to compensate for different pressures and conditions in system 10. For example, the pulse widths of the drive signals can be increased to compensate for lower pressures in system 10.

High pressure fuel pump 22 is mechanically coupled to engine 14 via a valve, gear, or clutch (e.g., dog) drive (not shown). Pump 22 may be a swash plate or cam ring piston pump which is mechanically coupled to engine 14 to rotate at a slower rate than engine 14. Low pressure pump 18 may be a vain pump, turbine pump, or roller pump which provides low pressure fuel at feed output or outlet 29 in response to the electrical power at inputs 58. Preferably, the electrical power at inputs 58 is provided as soon as electrical control system 38 is turned ON such as when an ignition key (not shown) is placed in the ignition (not shown) of engine 14.

The operation of high pressure fuel system 10 is discussed generally below as follows. Before engine 14 is started or cranked, a key is placed in the ignition (not shown) and the electrical power is provided on electrical inputs 58 to low pressure fuel pump 18. Low pressure fuel pump 18 pumps fuel 15 from tank 16 at a low pressure through fuel filter 20 to pump inlet 44 of high pressure pump 22.

Before engine 14 is started, high pressure pump 22 does not pump the fuel provided by pump 18 because engine 14 has not begun rotating, turning over, or cranking. High pressure pump 22 begins pumping when engine 14 begins cranking and does not provide highly pressured fuel at pump outlet 47 until engine 14 has rotated many times such as after engine 14 has been started. Alternatively, high pressure pump 22 may be configured to provide the highly pressurized fuel at outlet 47 during the cranking or starting of engine 14. However, high pressure pump 22 is not able to provide the fuel at full pressure or rated output until engine 14 has been rotated or cranked a significant number of times.

High pressure pump 22 prevents the fuel at pump inlet 22 from reaching pump outlet 47 because restrictive clearances in the pistons (not shown) of high pressure pump 22 block the path from inlet 44 to outlet 47. As engine 14 is started and high pressure pump 22 is unable to provide fuel at pump outlet 47 due to insufficient turns of engine 14, the fuel is provided to valve inlet 46 of combination check and relief valve 24. If the pressure at pump outlet 47 is less than the pressure at pump inlet 44, valve 24 allows fuel to flow from valve inlet 46 to valve outlet 48 so the fuel reaches regulator 28. The fuel provided at feed outlet 29 to pump inlet 44 generally exceeds the pressure of fuel provided at pump outlet 47 when engine 14 is initially started. Valve 24 is also configured to prevent fuel from flowing from valve outlet 48 to valve inlet 46.

When high pressure pump 22 provides the fuel at pump outlet 47 at a higher pressure than the fuel at pump inlet 44 (e.g., after engine 14 is started), valve 24 is closed and the fuel is prevented from flowing from valve inlet 46 to valve outlet 48. Additionally, the fuel is always preventing from flowing from valve outlet 48 to valve inlet 46 under normal conditions. Therefore, the fuel is able to bypass high pressure pump 22 when engine 14 is initially started or before pump 22 provides the fuel at full pressure. The fuel is essentially directly provided by low pressure pump 18 to engine 14 before engine 14 is completely started.

Combination check and relief valve 24 also advantageously provides a path from valve outlet 48 to valve inlet 46 when the pressure at pump outlet 47 reaches a predetermined threshold representative of an overpressure condition. The predetermined threshold is generally a pressure threshold below the proof pressure of the high pressure fuel system 10 and above the full pressure of pump 22. If high pressure pump 22 is deadheaded (e.g., pressure pump 22 is pumping into a closed system) due to a malfunction of regulator 28 or other portion of system 10, pump 22 can generate significant pressures at pump outlet 47. The pressures can exceed the proof pressure of system 10. When the pressure at pump outlet 47 reaches the predetermined threshold or overpressure threshold (e.g., preferably slightly above the full pressure or normal operating pressure of pump 22), valve 24 provides a path from valve outlet 48 to valve inlet 46 so that the fuel at outlet 47 is returned to tank 16, thereby preventing catastrophic failure of system 10. The configuration of valve 24 advantageously returns the fuel to tank 16 during an overpressure condition without the need for an additional fuel line or path to tank 16.

Figure 2:
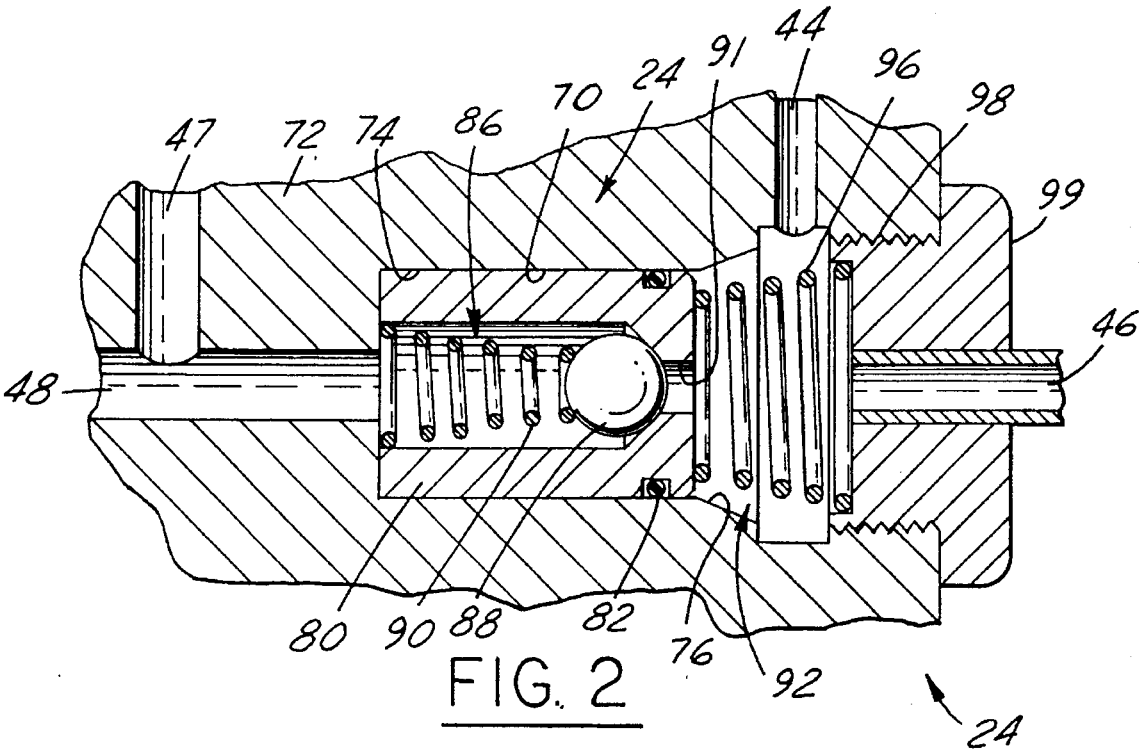
FIG. 2 is a cross-sectional view along the centerline of the cylindrical check and relief valve illustrated in FIG. 1.

FIG. 2 is a cross-sectional view along the centerline of combination check and relief valve 24. Check and relief valve 24 is preferably a cylindrical valve integrated within a stepped bore 70 in a housing 72 of high pressure fuel pump 22 (FIG. 1 ). Bore 70 includes a cylindrical section 74 and a chamfered section 76. A floating valve body 80 is seated within cylindrical section 74 of stepped bore 70. Valve body 80 is sealed within cylindrical section 74 by an O-ring 82. Preferably, cylindrical section 74, valve body 80, and O-ring 82 are sized to prevent leakage from valve inlet 46 to valve outlet 48.

Valve 24 includes a bypass assembly 86 and a relief assembly 92. Bypass assembly 86 is disposed within valve body 80 and includes a check ball 88, a check spring 90, and a body inlet 91. Check spring 90 biases check ball 88 against a body inlet 91. Body inlet 91 is in fluid communication with valve inlet 46 via chamfered section 76. Relief assembly 92 includes a relief spring 96, floating valve body 80, O-ring 82, and a fuel inlet fitting 99. Fuel inlet fitting 99 is threaded and engaged with threads 98 of chamfered section 76 to prove a leak proof seal. Relief spring 96 is disposed between valve body 80 and fitting 99 and biases valve body 80 in cylindrical section 74.

Valve 24 also includes valve inlet 46 and valve outlet 48. Valve inlet 46 is in fluid communication with chamfered section 76. Valve outlet 48 is in fluid communication with pump outlet 47. Valve inlet 46 is in fluid communication with pump inlet 44 via chamfered section 76.

The operation of valve 24 is discussed in more detail with reference to FIG. 2. When the pressure at valve inlet 46 exceeds the pressure at valve outlet 48 as when engine 14 is initially started, check ball 88 in bypass assembly 86 is moved against spring 90 and the fuel flows from valve inlet 46 through body inlet 91 to valve outlet 48. When the pressure of the fuel at valve outlet 48 exceeds the pressure of the fuel at valve outlet 46 as when engine 14 has been cranked or rotated many times or when high pressure pump 22 provides the rated pressure (e.g., pressure during normal operation of engine 14) at outlet 47, check ball 88 is forced against body inlet 91, thereby preventing fuel flow from valve inlet 46 and to valve outlet 48 and valve outlet 48 to valve inlet 46.

If an overpressure condition exists such as when high pressure pump 22 is deadheaded, excessive pressure builds at valve output 48. If the pressure is above a predetermined threshold below the proof pressure of system 10, floating valve body 80 is moved against relief spring 96. As body 80 is moved against relief spring 96 in relief assembly 92, O-ring 82 enters chamfered section 76 and the fuel is able to flow from valve outlet 48 around valve body 80 into chamfered section 76 and to valve inlet 46. Preferably, relief assembly 92 is designed so that the preload force of relief spring 96 is equal to the force on valve body 80 when the pressure at valve outlet 48 is at the predetermined threshold.

When the pressure at valve outlet 48 returns to normal conditions, relief spring 96 pushes valve body 80 back into cylindrical section 74 for normal operation of valve 24. Preferably, the preload force of relief spring 96 is chosen so that it corresponds to a pressure slightly above the normal operating pressure. Such a configuration ensures that valve body 80 is stationary during normal operation to protect valve body 80 and O-ring 82 from excessive wear. The distance from the nominal position of O-ring 82 when valve body 80 is seated within cylindrical section 74 to the position of O-ring 82 where it loses compression (e.g., an overpressure condition) is chosen so that relief spring 96 is compressed the proper distance by the pressure difference between operating pressure of pump 22 and the predetermined threshold.

It is understood that, while the detailed specific examples, and particular shapes given describe a preferred exemplary embodiment of the present invention, they are for the purposes of illustration only. The apparatus and method of the invention is not limited to the precise details and conditions disclosed. For example, although a gasoline fuel system 10 is shown, other types of fuel systems may be utilized. Also, although the preferred exemplary embodiment includes a check ball 88, other types of bypass valves may be utilized. Thus, various changes may be made to the details disclosed without departing from the spirit of the invention which is defined by the following claims.

What is claimed is:

1. An integral start bypass and pressure relief valve for use in a fuel system having a high pressure pump with a pump inlet and a pump outlet, the valve comprising:

a housing;

a valve inlet in said housing coupled to the pump inlet;

a valve outlet in said housing coupled to the pump outlet;

a first bypass valve means disposed in said housing between said valve inlet and said valve outlet to allow the fuel to flow from said valve inlet to said valve outlet when a fluid pressure difference across said valve inlet end said valve outlet exceeds a first limit, thereby allowing the fuel to bypass the high pressure pump when the high pressure pump is not providing highly pressurized fuel at the pump outlet; and a second bypass valve means disposed in said housing between said valve outlet and said valve inlet, said valve allowing the fuel to flow from the pump outlet to the pump inlet when the fluid pressure difference across said valve inlet and said valve outlet reaches a second limit.

2. The integral bypass valve of claim 1 wherein said second limit is representative of an overpressure condition for the fuel system.

3. The integral bypass valve of claim 1, further comprising:

a stepped bore section in said housing extending between said valve inlet and said valve outlet and said bore section having a cylindrical section and a chamfer section connecting said cylindrical section with said valve inlet;

a bypass valve body located in said cylindrical section, said valve body sealed within said cylindrical section by sealing means circumferentially around one end;

a relief spring in said chamfer section in contact with said valve body; and wherein said bypass valve body is movable in said cylindrical section against said relief spring and said sealing means able to enter said chamfer section, thereby allowing the fuel to flow from said pump outlet to said pump inlet around said valve body when the pressure difference exceeds said second limit.

4. The integral bypass valve of claim 2 wherein the first bypass valve includes a check ball disposed in said valve body between said valve inlet and valve outlet and a check valve spring biasing the check ball within said valve body.

5. A method of providing fuel in a fuel system from a tank to an engine as the engine is started, the fuel system including a feed pump in fluid communication with the tank, a high pressure pump having a pump input and a pump output, and a bypass valve, the feed pump having a feed output, the feed output being in fluid communication with the pump input, the bypass valve including a valve input in fluid communication with the pump input, and a valve output in fluid communication with the pump output, the feed pump providing the fuel at a first pressure, the high pressure pump providing the fuel at a second pressure, the second pressure being greater than the first pressure under normal conditions, the method comprising steps of:

operating the feed pump to provide the fuel at the first pressure to the pump input;

allowing the fuel at the first pressure to flow from the valve input to the valve output through the bypass valve and preventing the fuel from flowing through the bypass valve from the valve output to the valve input as the engine is started;

operating the high pressure pump to provide the fuel at the second pressure at the pump output;

preventing the fuel at the first pressure from flowing from the valve input through the bypass valve to the valve output after the engine is started; and then allowing the fuel to flow from the valve output through the bypass valve to the relief output when the second pressure reaches an overpressure threshold.

6. A fuel system for providing fuel from a tank to an engine, the fuel system comprising:

a feed pump in fluid communication with the tank, said feed pump having a feed output, said feed pump providing the fuel at a first pressure to said feed output;

a high pressure pump having a pump input and a pump output, said feed output being in fluid communication with said pump input, said high pressure pump providing the fuel at a second pressure at said pump output, said second pressure being higher than said first pressure under normal conditions; and an integral valve means having a bypass valve means including a valve input in fluid communication with said pump input, a valve output in fluid communication with said pump output, and a valve assembly disposed between said valve input and said valve output for allowing the fuel to flow from said valve input to said valve output when said first pressure is higher than said second pressure and preventing the fuel from flowing from said valve output to said valve input when said second pressure is higher than said first pressure but below a predetermined threshold pressure;

a relief output in fluid communication with said pump input; and a safety relief mechanism coaxially with said bypass valve means and disposed between said valve output and said relief output for allowing the fuel to flow from said pump output to said pump input when the second pressure reaches said predetermined threshold pressure.

7. A combined start bypass and safety pressure relief valve for use in a fuel system in an engine, the fuel system including a low pressure pump, and a high pressure pump, the low pressure pump having a feed outlet and the high pressure pump having a pump inlet and a pump outlet, the feed outlet being coupled to the pump inlet and the low pressure pump providing fuel at a low pressure to the pump inlet, the high pressure pump providing the fuel at a high pressure exceeding the low pressure after the engine has been started, the combined start bypass and safety pressure relief valve comprising:

a housing;

a valve inlet coupled to the pump inlet;

a valve outlet coupled to the pump outlet;

a bypass means, disposed in said housing between said valve inlet and said valve outlet, for providing fuel at the low pressure to said valve outlet before the engine has been started; and an overpressure means, disposed in said housing coaxially with said bypass means between said valve inlet and said valve outlet, for providing the fuel from said valve outlet to said pump inlet when the high pressure exceeds a predetermined threshold pressure.

8. The combined start bypass and safety pressure relief valve of claim 7, wherein said bypass means further includes a check ball and a spring, said spring bypassing the check ball to prevent fuel from flowing from said valve outlet to said valve inlet.

9. The fuel system according to claim 6, further comprising:

a stepped bore section in said housing having a cylindrical section extending between said inlet and said outlet and a chamfer section connecting said cylindrical section with said inlet, a valve body located in said cylindrical section;

sealing means circumferentially around one end of said valve body;

a relief spring in said chamfer section in contact with said valve body; and wherein said valve body is movable in said cylindrical section against said relief spring and said sealing means able to enter said chamfer section, thereby allowing the fuel to flow around said valve body from the pump outlet to the pump inlet when the pressure difference exceeds said second limit.

10. The fuel system according to claim 9 wherein the first bypass valve includes a check ball disposed in said valve body between said valve inlet and valve outlet and a check valve spring biasing the check ball within said valve body, located in said cylindrical section.

* * * * *